US009404662B2

(12) United States Patent
Armstrong

(10) Patent No.: US 9,404,662 B2
(45) Date of Patent: Aug. 2, 2016

(54) MICROWAVE APPLIANCE

(71) Applicant: General Electric Company, Schenectady, NY (US)

(72) Inventor: James Lee Armstrong, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 415 days.

(21) Appl. No.: 14/149,885

(22) Filed: Jan. 8, 2014

(65) Prior Publication Data

US 2015/0192306 A1 Jul. 9, 2015

(51) Int. Cl.
*H05B 6/64* (2006.01)
*F24C 15/20* (2006.01)

(52) U.S. Cl.
CPC ..... *F24C 15/2042* (2013.01); *F24C 15/2035* (2013.01); *H05B 6/6402* (2013.01); *H05B 6/6423* (2013.01)

(58) Field of Classification Search
CPC ..... F24C 15/2042; F24C 15/2035; H05B 6/6423; H05B 6/6402
USPC ..... 219/757, 702, 718, 710, 721, 681, 400; 126/21 A, 21 R, 198, 299 D, 299 R, 126/273 A; 427/386, 387, 388.1
See application file for complete search history.

(56) References Cited

U.S. PATENT DOCUMENTS

| | | | | |
|---|---|---|---|---|
| 3,328,560 | A | 6/1967 | Dills | |
| 3,496,704 | A * | 2/1970 | Bandlow | F24C 15/2092 126/299 D |
| 4,089,327 | A * | 5/1978 | Welsh | F24C 15/20 126/299 D |
| 7,629,561 | B2 * | 12/2009 | Sohn | F24C 15/006 126/21 A |
| 2005/0092746 | A1 * | 5/2005 | Song | H05B 6/6423 219/757 |

* cited by examiner

*Primary Examiner* — Quang Van
(74) *Attorney, Agent, or Firm* — Dority & Manning, P.A.

(57) ABSTRACT

A microwave appliance is provided. The microwave appliance includes a cabinet and a duct mounted to the cabinet. A filter is mounted to the duct at an opening of the duct. The filter has projections that are received within channels of the duct. The projections and channels can assist with properly positioning and/or orienting the filter within the duct.

19 Claims, 6 Drawing Sheets

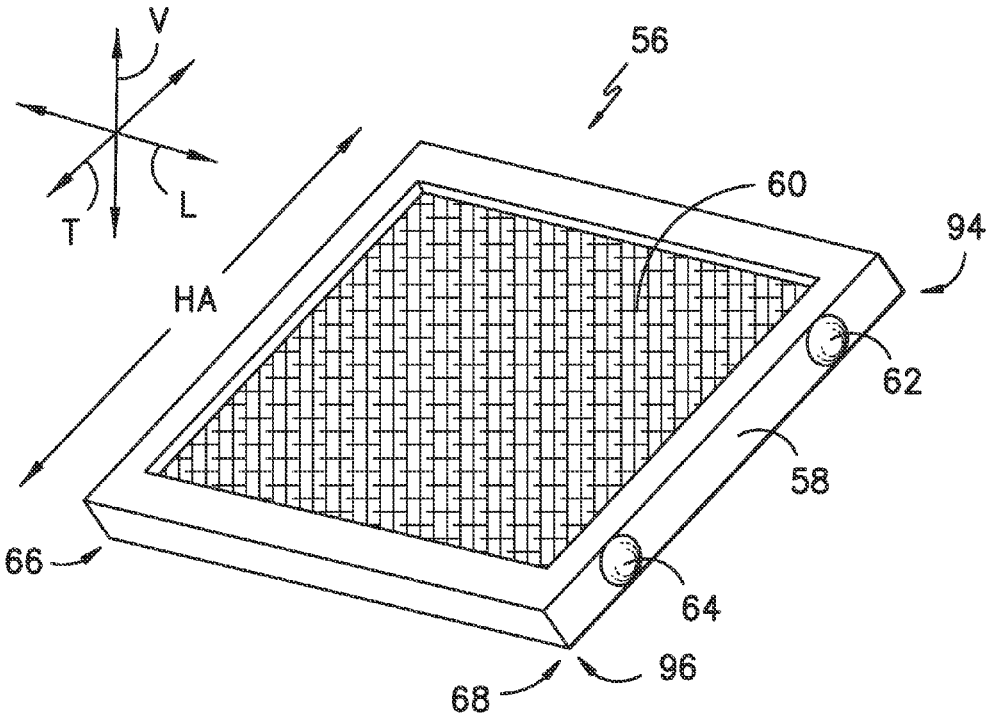
FIG. —4—
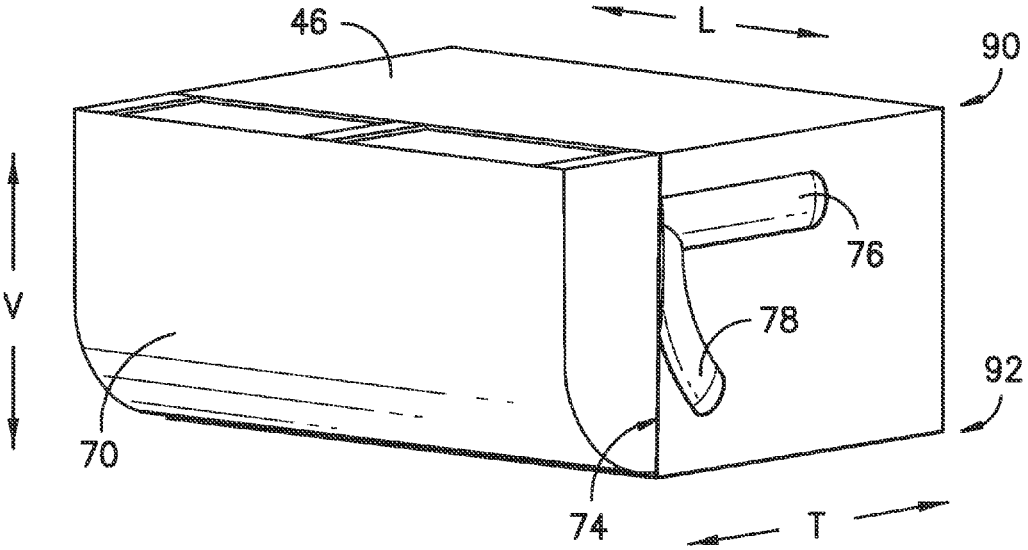
FIG. 5

MICROWAVE APPLIANCE

FIELD OF THE INVENTION

The present subject matter relates generally to microwave appliances, such as over-the-range microwave appliances.

BACKGROUND OF THE INVENTION

Over-the-range microwave appliances are generally mounted above a cooktop of an oven range appliance. In addition to providing for heating of food and beverage items, certain over-the-range microwave appliances include a circulation system. When activated, the circulation system can draw fumes, smoke, grease, and/or steam away from the cooktop of the oven range appliance. Circulation systems generally include a fan for drawing a flow of air into the circulation system and a filter. The circulation assembly's filter can assist with removing dust, particulates, smoke, grease and/or other undesirable substances from air passing therethrough.

The filter is generally removable so that the filter can be serviced or replaced. However, removing the filter and properly replacing the filter can be difficult. Due to such difficulty, filters are commonly improperly oriented or positioned within the microwave appliance. Improperly replacing the filter within microwave appliance can negatively affect the circulation system's air filtration. In particular, air can bypass the filter when the filter is improperly installed.

Accordingly, a microwave appliance with features for assisting installation of a filter within the microwave appliance would be useful. In addition, a microwave appliance with features for assisting proper positioning and/or orienting a filter within the microwave appliance would be useful.

BRIEF DESCRIPTION OF THE INVENTION

The present subject matter provides a microwave appliance. The microwave appliance includes a cabinet and a duct. A filter is mounted to the duct at an opening of the duct. The filter has projections that are received within channels of the duct. The projections and channels can assist with properly positioning and/or orienting the filter within the duct. Additional aspects and advantages of the invention will be set forth in part in the following description, or may be apparent from the description, or may be learned through practice of the invention.

In a first exemplary embodiment, a microwave appliance is provided. The microwave appliance includes a cabinet that defines a cooking chamber. A duct is mounted to the cabinet and defines an opening. The duct also defines a first pair of channels and a second pair of channels at the opening. A filter is mounted to the duct at the opening of the duct. The filter has a first pair of projections and a second pair of projections. Each projection of the first pair of projections is received within a respective one of the first pair of channels of the duct. Each projection of the second pair of projections is received within a respective one of the second pair of channels of the duct.

In a second exemplary embodiment, a microwave appliance defines a vertical direction, a lateral direction and a transverse direction. The vertical, lateral and transverse directions are mutually perpendicular. The microwave appliance includes a cabinet that defines a cooking chamber and extends between a top portion and a bottom portion along the vertical direction. A duct defines an opening adjacent the top portion of the cabinet. The duct also defines a first pair of channels and a second pair of channels at the opening. A filter is positioned at the opening of the duct. The filter has a frame, a first pair of projections and a second pair of projections. The first and second pairs of projections extend from the frame along the lateral direction. Each projection of the first pair of projections is received within a respective one of the first pair of channels of the duct. Each projection of the second pair of projections is received within a respective one of the second pair of channels of the duct.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 4 provides a perspective view of a filter of the exemplary microwave appliance of FIG. 1.

FIGS. 5, 6, 7, 8 and 9 provide perspective views of the filter of FIG. 4 in various stages of being mounted to the duct of FIG. 3.

DETAILED DESCRIPTION

Figure 1:
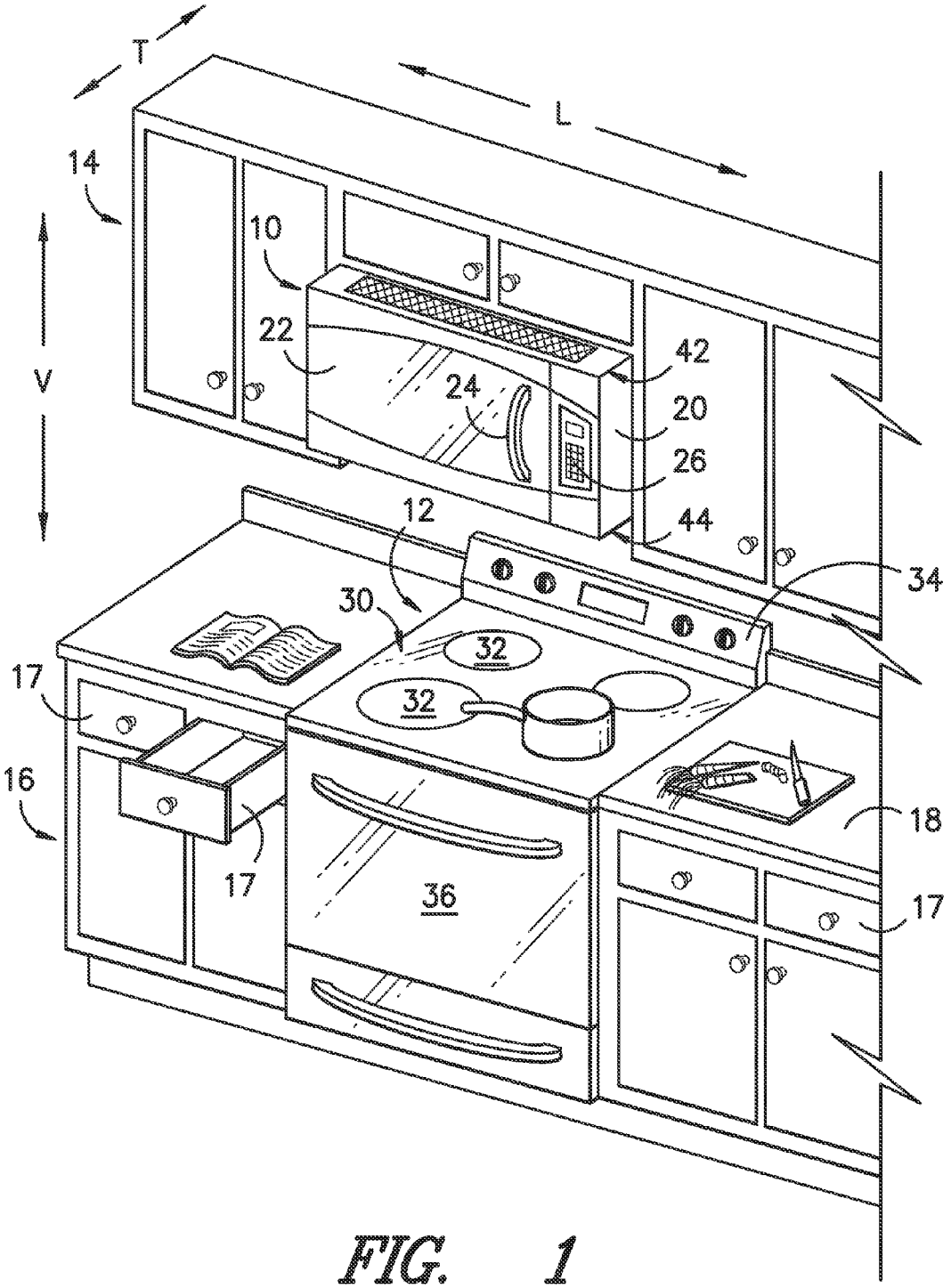
FIG. 1 provides a perspective view of a microwave appliance according to an exemplary embodiment of the present subject matter mounted to a kitchen cabinet above an oven range appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a microwave appliance 10 according to an exemplary embodiment of the present subject matter mounted to an upper set of kitchen cabinets 14 above an oven range appliance 12, e.g., along a vertical direction V. Microwave appliance 10 shown in FIG. 1 is commonly referred to as an over-the-range microwave. It should be understood that, in alternative exemplary embodiments, the present subject matter may be used in any other suitable microwave appliance. Microwave appliance 10 defines a vertical direction V, a lateral direction L and a transverse direction T. The vertical direction V, the lateral direction L and the transverse direction T are mutually perpendicular and form an orthogonal direction system.

As discussed above, microwave appliance 10 is mounted to upper set of kitchen cabinets 14. Upper set of kitchen cabinets 14 is positioned above a base set of kitchen cabinets 16, e.g., along the vertical direction V. Base set of kitchen cabinets 16 includes countertops 18 and drawers 17. Microwave appliance 10 is positioned above base set of kitchen cabinets 16, e.g., along the vertical direction V. Oven range appliance 12 is received within base set of kitchen cabinets 16 below microwave appliance 10. In particular, a cooking surface 30 of oven range appliance 12 is positioned, e.g., directly, below microwave appliance 10 along the vertical direction V. Microwave appliance 10 can include features such as an air handler or fan 52 (FIG. 2) that can draw cooking vapors and/or smoke away from cooking surface 30, e.g., and out of the kitchen containing microwave and oven range appliances 10 and 12.

Microwave appliance 10 is configured for receipt of food items for cooking. In particular, microwave appliance 10 includes a cabinet or casing 20 and a door 22 that permits selective access to an interior of microwave appliance 10 and casing 20. Door 22 includes a handle 24 that a user can pull to open door in order to insert food items into microwave appliance 10. Microwave appliance 10 also includes controls 26 that permit a user to make selections for cooking of food items, e.g., a duration of a cooking cycle of microwave appliance 10 and/or a power setting for the cooking cycle of microwave appliance 10.

As discussed above, oven range appliance 12 includes cooking surface 30. Cooking surface 30 includes heated portions 32 that may be heated by heating elements (not shown), e.g., electrical resistive heating elements, gas burners, induction heating elements, and/or any other suitable heating element of combination of heating elements. Oven range appliance 12 also includes a door 36 that permits access to a heated compartment (not shown) of oven range appliance 12, e.g., for cooking or baking of food items therein. A control panel 34 of oven range appliance 12 can permit a user to make selections for cooking of food items, e.g., a duration of a cooking cycle of oven range appliance 12 and/or a power setting for the cooking cycle of oven range appliance 12.

Figure 2:
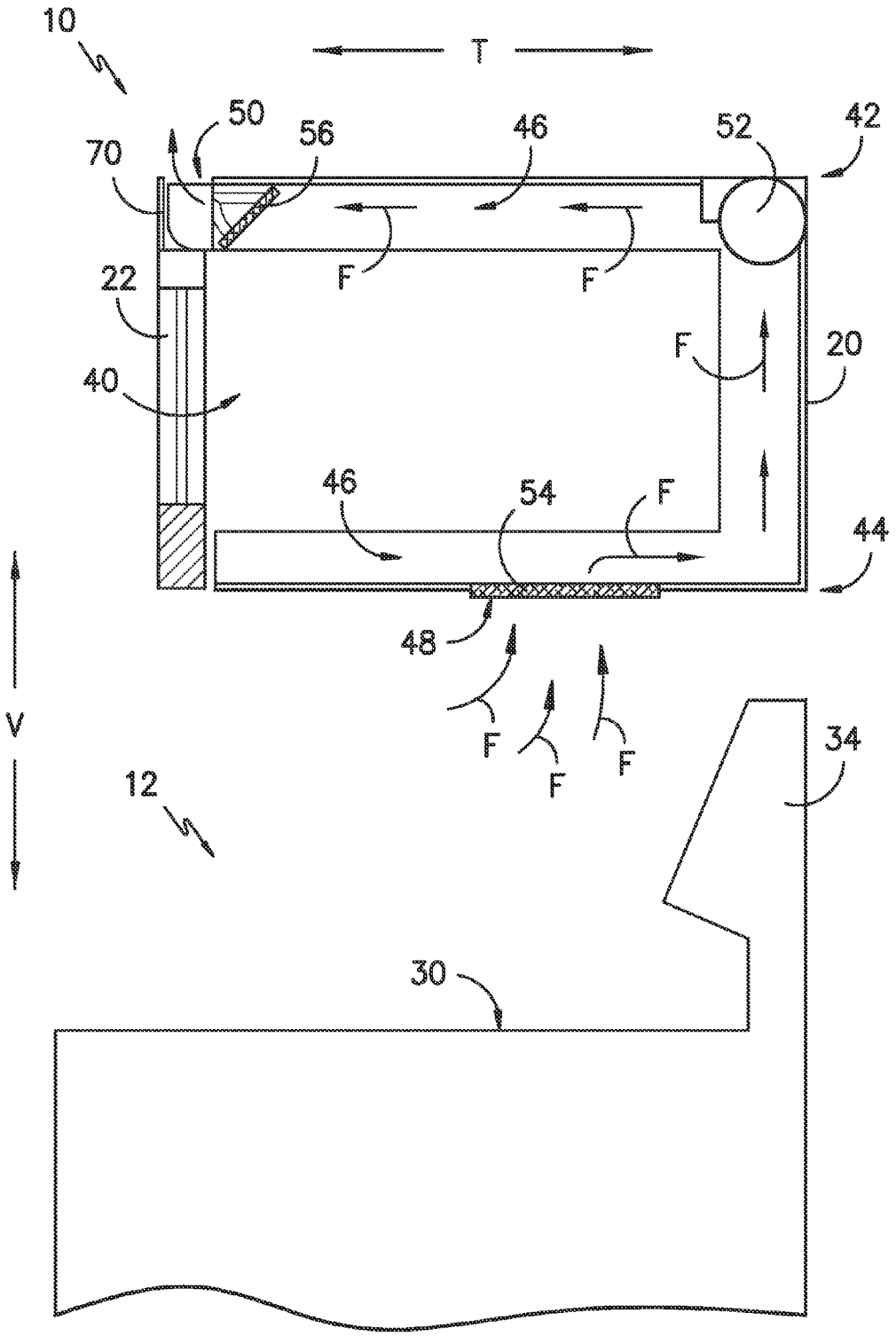
FIG. 2 provides a side, section view of the exemplary microwave appliance and the oven range appliance of FIG. 1.

FIG. 2 provides a side, section view of microwave appliance 10 and oven range appliance 12. As may be seen in FIG. 2, casing 20 extends between a top portion 42 and a bottom portion 44, e.g., along the vertical direction V. Thus, top and bottom portions 42 and 44 of casing 20 are spaced apart from each other, e.g., along the vertical direction V. Casing 20 defines a cooking chamber 40 configured for receipt of food items for cooking. Door 22 of microwave appliance 10 permits selective access to cooking chamber 40 of casing 20. In particular, door 22 of microwave appliance 10 is selectively adjustable between an open position (not shown) and a closed position (FIGS. 1 and 2). In the closed position, door 22 of microwave appliance 10 hinders access to cooking chamber 40 of casing 20. Conversely, door 22 of microwave appliance 10 permits access to cooking chamber 40 of casing 20 in the open position. A user can pull on handle 24 of door 22 of microwave appliance 10 in order to shift door 22 from the closed position shown in FIG. 2 to the open position.

Casing 20 also includes or defines a circulation duct or conduit 46. Circulation conduit 46 has an inlet 48 and an outlet 50. Circulation conduit 46 extends between inlet 48 and outlet 50. Inlet 48 of circulation conduit 46 is positioned at or adjacent bottom portion 44 of casing 20, e.g., such that inlet 48 of circulation conduit 46 faces cooking surface 30 of oven range appliance 12. Conversely, outlet 50 of circulation conduit 46 is positioned at or adjacent top portion 42 of casing 20, e.g., such that outlet 50 of circulation assembly 46 faces away from cooking surface 30 of oven range appliance 12. Thus, inlet 48 and outlet 50 of circulation conduit 46 are spaced apart from each other, e.g., along the vertical direction V. Circulation conduit 46 may be formed by a discrete component mounted to casing 20 and/or be integrally formed with casing 20.

Microwave appliance 10 also includes a fan 52, such as an axial fan or a radial fan. Fan 52 is positioned within or adjacent circulation conduit 46. Fan 52 draws or urges a flow of air (shown with arrows F) through circulation conduit 46 when fan 52 is in an activated state. Conversely, fan 52 does not draw or urge flow of air F through circulation conduit 46 when fan 52 is in a deactivated state. When fan 52 is in the activated state, flow of air F enters circulation conduit 46 at or through inlet 48 of circulation conduit 46. Flow of air F is directed through circulation conduit 46 to outlet 50, and flow of air F can exit circulation conduit 46 at outlet 50 of circulation conduit 46.

A grease filter 54 is positioned within circulation conduit 46. In particular, grease filter 54 is positioned at or adjacent inlet 48 of circulation conduit 46. Grease filter 54 can assist with removing or filtering grease or other large particles from flow of air F when flow of air F passes through grease filter 54 at inlet 48 of circulation conduit 46. Grease filter 54 may be constructed with an aluminum mesh or a baffle assembly.

Microwave appliance 10 also includes an air filter 56. Air filter 56 is mounted to casing 20 such that flow of air F within circulation conduit 46 passes through air filter 56 when fan 52 is in the activated state. In the exemplary embodiment shown in FIG. 2, air filter 56 is positioned within circulation conduit 46 at outlet 50 of circulation conduit 46. It should be understood that in alternative exemplary embodiments, air filter 56 may be positioned at any other suitable location on microwave appliance 10.

As may be seen in FIG. 2, air filter 56 is positioned downstream of grease filter 54 in flow of air F. In such a manner, grease filter 54 can filter grease and other large particles from flow of air F before flow of air F passes through air filter 56. Grease filter 54 can improve a lifetime of air filter 56 by removing such contaminants from flow of air F rather than air filter 56. Thus, grease filter 54 can be configured for removing relatively large particles from flow of air F, and air filter 56 can be configured for removing relatively small particles from flow of air F. Air filter 56 can include any suitable filter or mechanism for removing particles from flow of air F. For example, air filter 56 may include a charcoal air filter medium, a high-efficiency particulate air filter medium, or an electrostatic air filter medium.

Figure 3:
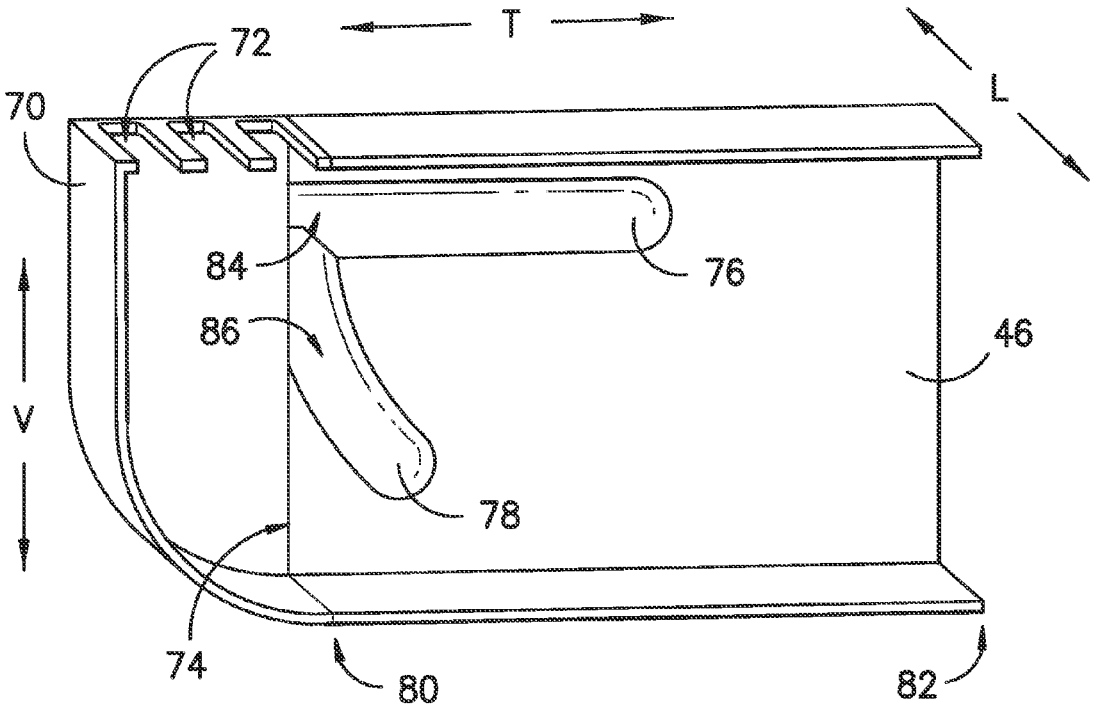
FIG. 3 provides a section view of a duct and a vent cover of the exemplary microwave appliance of FIG. 1.

FIG. 3 provides a section view of circulation conduit 46 and a vent cover 70 of microwave appliance 10. As may be seen in FIG. 3, circulation conduit 46 defines an opening 74. Opening 74 of circulation conduit 46 can be positioned at any suitable location on microwave appliance 10. For example, opening 74 of circulation conduit 46 may be positioned at or adjacent top portion 42 of casing 20. Thus, opening 74 of circulation conduit 46 may be positioned at or adjacent outlet 50 of circulation conduit 46. As another example, opening 74 of circulation conduit 46 may be positioned at or adjacent inlet 48 of circulation conduit 46.

Vent cover 70 is mounted to circulation conduit 46 at or adjacent opening 74 of circulation conduit 46. Vent cover 70 has an outlet grill 72. Vent cover 70 can assist with protecting circulation conduit 46. In particular, outlet grill 72 can be sized to permit the flow of air F (FIG. 2) through vent cover 70 while also hindering or preventing relatively large objects from passing through vent cover 70 into circulation conduit 46.

Circulation conduit 46 defines a first pair of channels 76 and a second pair of channels 78 at or adjacent opening 74 of circulation conduit 46 (only one channel of first and second pairs of channels 76 and 78 is shown in FIG. 3). First pair of channels 76 and second pair of channels 78 can be formed in any suitable manner. For example, first and second pairs of channels 76 and 78 may be embossed or molded on circulation conduit 46.

First and second pairs of channels 76 and 78 can have any suitable shape. For example, circulation conduit 46 extends between a front portion 80 and a back portion 82, e.g., along the transverse direction T. First channels 76 may extend linearly, e.g., rectilinearly, from front portion 80 of circulation conduit 46 towards back portion 82 of circulation conduit 46. Conversely, second channels 78 may extend arcuately from front portion 80 of circulation conduit 46 towards back portion 82 of circulation conduit 46. Thus, first and second pairs of channels 76 and 78 may have different shapes.

The channels of first pair of channels 76 are spaced apart from each other, e.g., along the lateral direction L. Thus, a respective channel of first pair of channels 76 may be positioned at or adjacent each lateral side of circulation conduit 46. The channels of second pair of channels 78 are also spaced apart from each other, e.g., along the lateral direction L. Thus, a respective channel of second pair of channels 78 may be positioned at or adjacent each lateral side of circulation conduit 46. First pair of channels 76 may also be positioned above second pair of channels 78, e.g., along the vertical direction V. In addition, each channel of first pair of channels 76 has an entrance 84, and each channel of second pair of channels 78 also has an entrance 86. Each entrance 84 of first pair of channels 76 may be positioned at a respective entrance 86 of second pair of channels 78.

FIG. 4 provides a perspective view of air filter 56 of microwave appliance 10. Air filter 56 is mountable to circulation conduit 46 (FIG. 3) at opening 74 of circulation conduit 46 as discussed in greater detail below. As may be seen in FIG. 4, air filter 56 has a frame 58 and a filter medium 60. Filter medium 60 is disposed or mounted within frame 58. Filter medium 60 can be any suitable filtering medium. For example, filter medium 60 may include a charcoal air filter medium, a high-efficiency particulate air filter medium, an electrostatic air filter medium, etc. or combinations thereof.

Air filter 56 also includes a first pair of projections 62 and a second pair of projections 64. First pair of projections 62 and second pair of projections 64 can be formed in any suitable manner. For example, first and second pairs of projections 62 and 64 may be mounted to, embossed or molded on frame 58. The projections of first and second pairs of projections 62 and 64 extend from frame 58, e.g., along the lateral direction L. First and second pairs of projections 62 and 64 are receivable within first and second pairs of channels 76 and 78, respectively, as discussed in greater detail below. Thus, a shape of first and second pairs of projections 62 and 64 may be complementary to a shape of first and second pairs of channels 76 and 78, respectively.

Air filter 56 extends between a first side portion 66 and a second side portion 68, e.g., along the lateral direction L. A respective one of first pair of projections 62 is positioned at each of first and second side portions 66 and 68 of air filter 56. Similarly, a respective one of second pair of projections 64 is positioned at each of first and second side portions 66 and 68 of air filter 56. Thus, the projections of first pair of projections 62 are spaced apart from each other, e.g., along the lateral direction L, and the projections of second pair of projections 64 are spaced apart from each other, e.g., along the lateral direction L.

Figure 6:
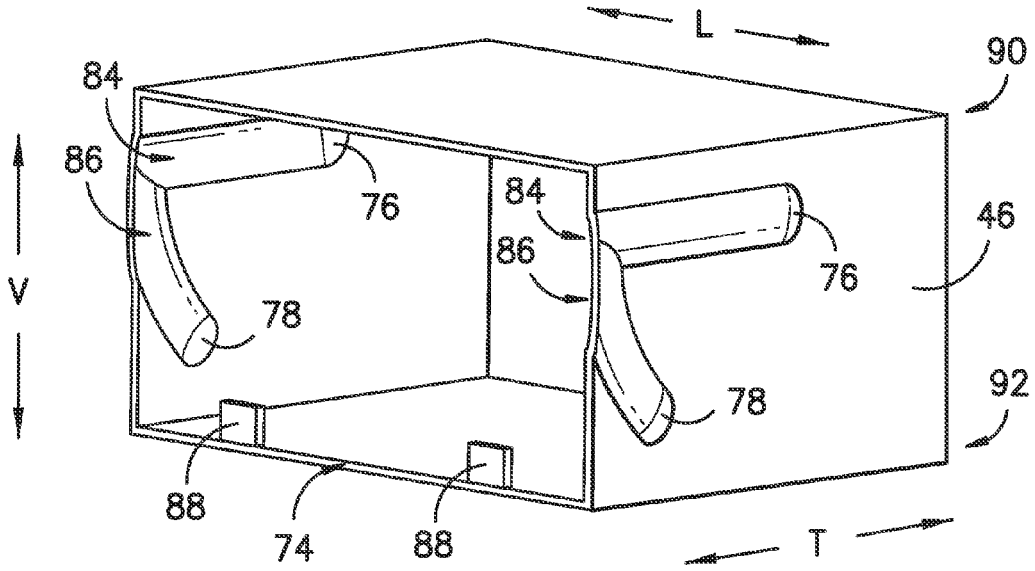

FIGS. 5, 6, 7, 8 and 9 provide perspective views of air filter 56 in various stages of being mounted to circulation conduit 46. As may be seen in FIG. 5, vent cover 70 is mounted to circulation conduit 46. Turning to FIG. 6, a user of microwave appliance 10 can remove vent cover 70 from circulation conduit 46 to access or expose opening 74 of circulation conduit 46.

Figure 7:
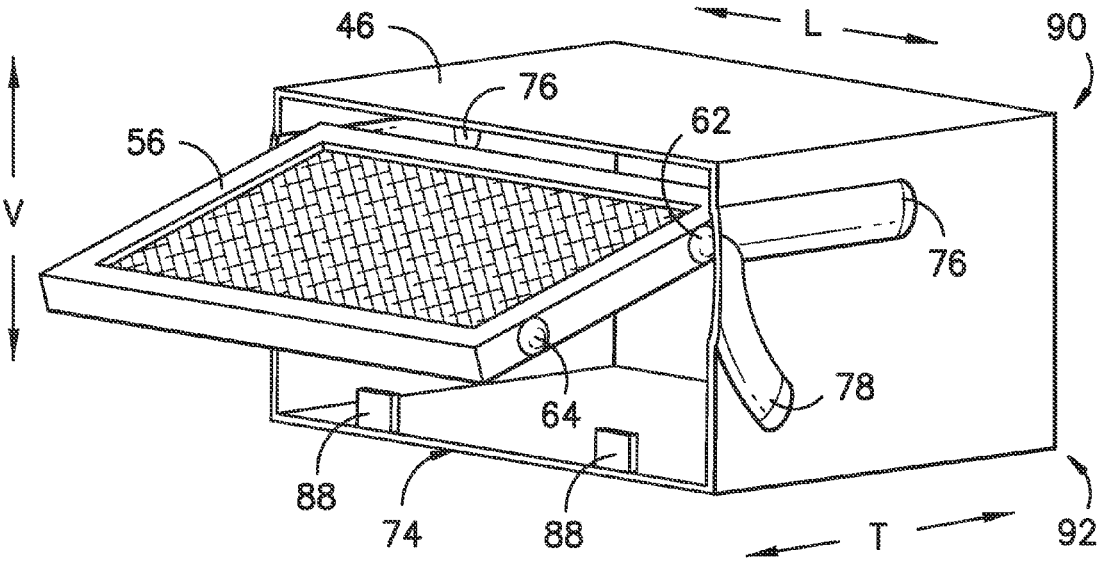
Figure 8:
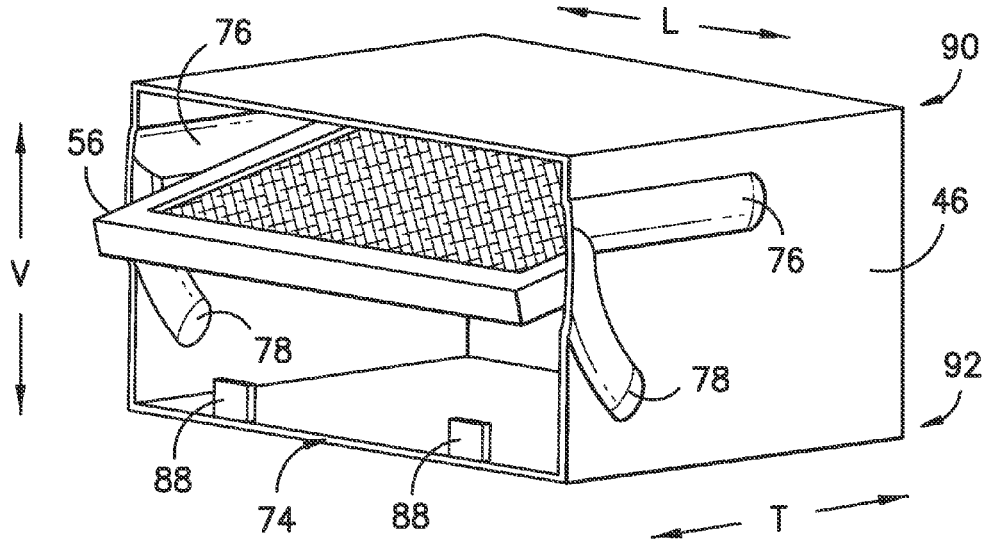

As may be seen in FIG. 7, the user can position and align each projection of first pair of projections 62 with a respective one of first pair of channels 76 of circulation conduit 46, e.g., each entrance 84 of first pair of channels 76. Turning now to FIG. 8, the user can slide air filter 56 into circulation conduit 46 such that each projection of first pair of projections 62 is received within a respective one of first pair of channels 76 of circulation conduit 46. The user can continue to slide air filter 56 into circulation conduit 46 until each projection of second pair of projections 64 is aligned with and positioned at a respective one of second pair of channels 78 of circulation conduit 46, e.g., each entrance 86 of second pair of channels 78.

Figure 9:
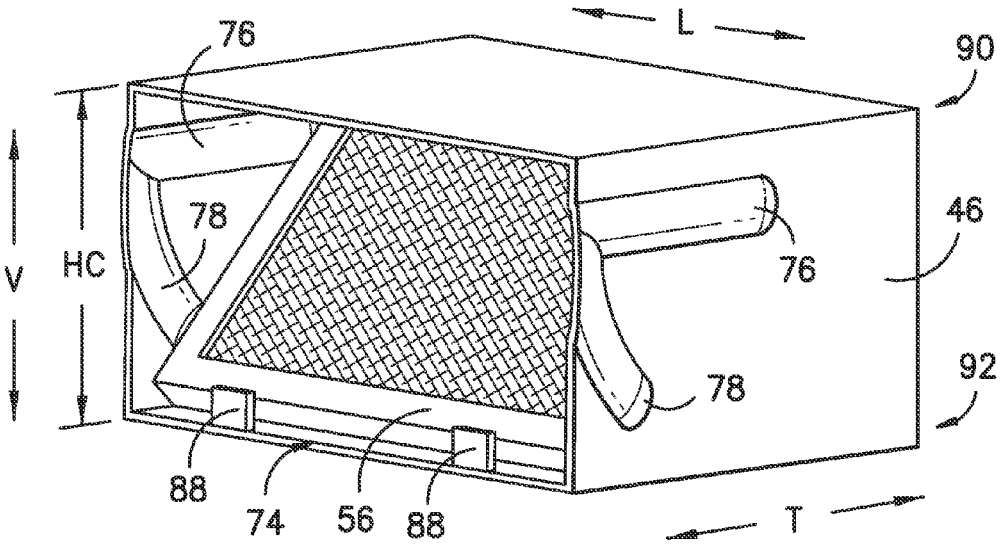

Turning now to FIG. 9, the user can drop or rotate air filter 56 downwardly such that each projection of second pair of projections 64 is received within a respective one of second pair of channels 78 of circulation conduit 46. In addition, the user can place air filter 56 (e.g., frame 58 of air filter 56) against tabs 88 positioned at a bottom portion 92 of circulation conduit 46. Tabs 88 can hinder or prevent undesired movement of air filter 56 within circulation conduit 46. In such a manner, air filter 56 can be removably mounted within circulation conduit 46. Vent cover 70 (FIG. 5) may also be replaced on circulation conduit 46 after air filter 56 is properly positioned within circulation conduit 46.

As may be seen in FIG. 9, circulation conduit 46 extends between a top portion 90 and a bottom portion 92, e.g., along the vertical direction V. Circulation conduit 46 defines a height HC along the vertical direction V at or adjacent opening 74 of circulation conduit 46, e.g., between top and bottom portions 90 and 92 of circulation conduit 46. Turning back to FIG. 4, air filter 56 also extends between a top portion 94 and a bottom portion 96. Air filter 56 defines a height HA, e.g., between top and bottom portions 94 and 96 of air filter 56. The height HC of circulation conduit 46 and the height HA of air filter 56 can be any suitable heights. For example, the height HA of air filter 56 may be greater than the height HC of circulation conduit 46 such that air filter 56 is angled within circulation conduit 46 when air filter 56 is mounted within circulation conduit 46 as shown in FIG. 9. When air filter 56 is angled within circulation conduit 46, top portion 90 of air filter 56 is positioned above bottom portion 92 of air filter 56 along the vertical direction V, but top portion 90 of air filter 56 is not aligned with or positioned directly above bottom portion 92 of air filter 56 along the vertical direction V when air filter 56 is angled within circulation conduit 46.

With air filter 56 angled within circulation conduit 46, first and second pairs of projections 62 and 64 of air filter 56 and first and second pairs of channels 76 and 78 of circulation conduit 46 can assist with properly positioning air filter 56 within circulation conduit 46. For example, such features can provide visual and mechanical feedback to the user of microwave appliance 10 installing air filter 56 within circulation conduit 46. In addition, due to first and second pairs of projections 62 and 64 of air filter 56, a width of air filter 56, e.g., along the lateral direction L, may be greater than a width of portions of circulation conduit 46, e.g., along the lateral direction L. Thus, air filter 56 may not fit within circulation conduit 46 without positioning first and second pairs of projections 62 and 64 of air filter 56 within first and second pairs of channels 76 and 78 of circulation conduit 46 as discussed above. In such a manner, a user can be prevented or hindered from improperly positioning air filter 56 within circulation conduit 46.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A microwave appliance, comprising:

a cabinet defining a cooking chamber;

a duct positioned adjacent the cabinet and having an opening, the duct also defining a first pair of channels and a second pair of channels at the opening; and a filter mounted to the duct at the opening of the duct, the filter having a first pair of projections and a second pair of projections, each projection of the first pair of projections received within a respective one of the first pair of channels of the duct, each projection of the second pair of projections received within a respective one of the second pair of channels of the duct.

2. The microwave appliance of claim 1, wherein the filter extends between a first side portion and a second side portion, a respective one of the first pair of projections positioned at each of the first and second side portions of the filter, a respective one of the second pair of projections positioned at each of the first and second side portions of the filter.

3. The microwave appliance of claim 1, wherein the filter comprises a frame and a filter medium disposed within the frame, the first and second pairs of projections positioned on the frame.

4. The microwave appliance of claim 3, wherein the filter medium comprises activated carbon.

5. The microwave appliance of claim 1, wherein the opening of the duct is positioned adjacent a top portion of the cabinet.

6. The microwave appliance of claim 1, further comprising a vent cover mounted to the duct at the opening of the duct, the vent cover having an outlet grill.

7. The microwave appliance of claim 1, wherein the channels of the first pair of channels extend linearly from a front portion of the duct towards a back portion of the duct, wherein the channels of the second pair of channels extend arcuately from the front portion of the duct towards the back portion of the duct.

8. The microwave appliance of claim 7, wherein the first pair of channels is positioned above the second pair of channels.

9. The microwave appliance of claim 1, wherein the duct comprises a tab positioned at a bottom portion of the duct, the filter positioned against the tab.

10. The microwave appliance of claim 1, further comprising a fan mounted to the cabinet, the fan drawing a flow of air through the duct and the filter when the fan is operated.

11. A microwave appliance defining a vertical direction, a lateral direction and a transverse direction, the vertical, lateral and transverse directions being mutually perpendicular, the microwave appliance comprising:

a cabinet defining a cooking chamber and extending between a top portion and a bottom portion along the vertical direction;

a duct defining an opening adjacent the top portion of the cabinet, the duct also defining a first pair of channels and a second pair of channels at the opening; and a filter positioned at the opening of the duct, the filter having a frame, a first pair of projections and a second pair of projections, the first and second pairs of projections extending from the frame along the lateral direction, each projection of the first pair of projections received within a respective one of the first pair of channels of the duct, each projection of the second pair of projections received within a respective one of the second pair of channels of the duct.

12. The microwave appliance of claim 11, wherein the filter extends between a first side portion and a second side portion along the lateral direction, a respective one of the first pair of projections positioned at each of the first and second side portions of the filter, a respective one of the second pair of projections positioned at each of the first and second side portions of the filter.

13. The microwave appliance of claim 11, wherein the filter comprises an activated carbon filter medium disposed within the frame.

14. The microwave appliance of claim 11, further comprising a vent cover mounted to the duct at the opening of the duct, the vent cover having an outlet grill.

15. The microwave appliance of claim 11, wherein the duct extends between a front portion and a back portion along the transverse direction, the channels of the first pair of channels extending linearly from the front portion of the duct towards the back portion of the duct, the channels of the second pair of channels extend arcuately from the front portion of the duct towards the back portion of the duct.

16. The microwave appliance of claim 15, wherein the first pair of channels is positioned above the second pair of channels along the vertical direction.

17. The microwave appliance of claim 11, further comprising a fan mounted to the cabinet, the fan drawing a flow of air through the duct and the filter when the fan is operated.

18. The microwave appliance of claim 11, wherein each channel of the first and second pairs of channels has an entrance, each entrance of the first pair of channels positioned at a respective entrance of the second pair of channels.

19. The microwave appliance of claim 11, wherein the duct defines a height along the vertical direction at the opening of the duct, the filter also extending between a top portion and a bottom portion along a height, the height of the filter being greater than the height of the duct such that the filter is angled within the duct.

* * * * *